US009004555B1

(12) United States Patent
Chirico

(10) Patent No.: US 9,004,555 B1
(45) Date of Patent: Apr. 14, 2015

(54) PET WASTE DISPOSAL KIT AND METHOD

(71) Applicant: Louis Chirico, Vienna, NJ (US)

(72) Inventor: Louis Chirico, Vienna, NJ (US)

( * ) Notice: Subject to any disclaimer, the term of this patent is extended or adjusted under 35 U.S.C. 154(b) by 0 days.

(21) Appl. No.: 14/049,643

(22) Filed: Oct. 9, 2013

(51) Int. Cl.
*A01K 29/00* (2006.01)
*A01K 23/00* (2006.01)
*E01H 1/12* (2006.01)

(52) U.S. Cl.
CPC ..... *E01H 1/1206* (2013.01)

(58) Field of Classification Search
USPC ..... 294/1.3, 1.4, 1.5, 25, 150, 152, 155, 294/156, 170; 2/158, 159, 167; 206/223, 206/233, 541, 581; 224/162, 660, 664; 383/38, 41, 42, 103; D30/162; 119/161, 651, 867
See application file for complete search history.

(56) References Cited

U.S. PATENT DOCUMENTS 4,350,274 A * 9/1982 Morgan ..... 224/610
4,677,697 A * 7/1987 Hayes ..... 2/159
4,917,238 A * 4/1990 Schumacher ..... 206/223
5,447,227 A * 9/1995 Kosberg ..... 206/233
5,560,321 A * 10/1996 Hess ..... 119/858
6,129,096 A * 10/2000 Johnson ..... 294/1.3
6,257,473 B1 * 7/2001 Ringelstetter ..... 224/675
6,607,226 B1 * 8/2003 Poncy ..... 294/25
7,073,462 B1 * 7/2006 Layman ..... 119/867
2005/0279290 A1 * 12/2005 Hyland ..... 119/867
2006/0231043 A1 * 10/2006 Galdo ..... 119/796
2011/0210571 A1 * 9/2011 Dan ..... 294/1.3

* cited by examiner

*Primary Examiner* — Paul T Chin
(74) *Attorney, Agent, or Firm* — Thomas J. Germinario

(57) ABSTRACT

A pet waste disposal kit includes a kit bag with an impermeable lining that can be worn around the waist or over the shoulder of the pet handler. The kit bag serves as the secondary container for filled waste collection bags, and it also serves to store the other materials contained in the kit. The kit also includes a supply of lightweight, impermeable, biodegradable plastic gloves, which can be made of biodegradable polyethylene, and a supply of waste collection bags made of lightweight, impermeable, biodegradable plastic, containing a disinfecting-deodorizing mixture. The disinfecting-deodorizing mixture contains a highly alkaline compound, a desiccant and a deodorizer. The waste collection bags have resealable zip-locks or twist ties. The kit also includes a supply of antiseptic hand wipes or a liquid hand sanitizer.

1 Claim, 1 Drawing Sheet

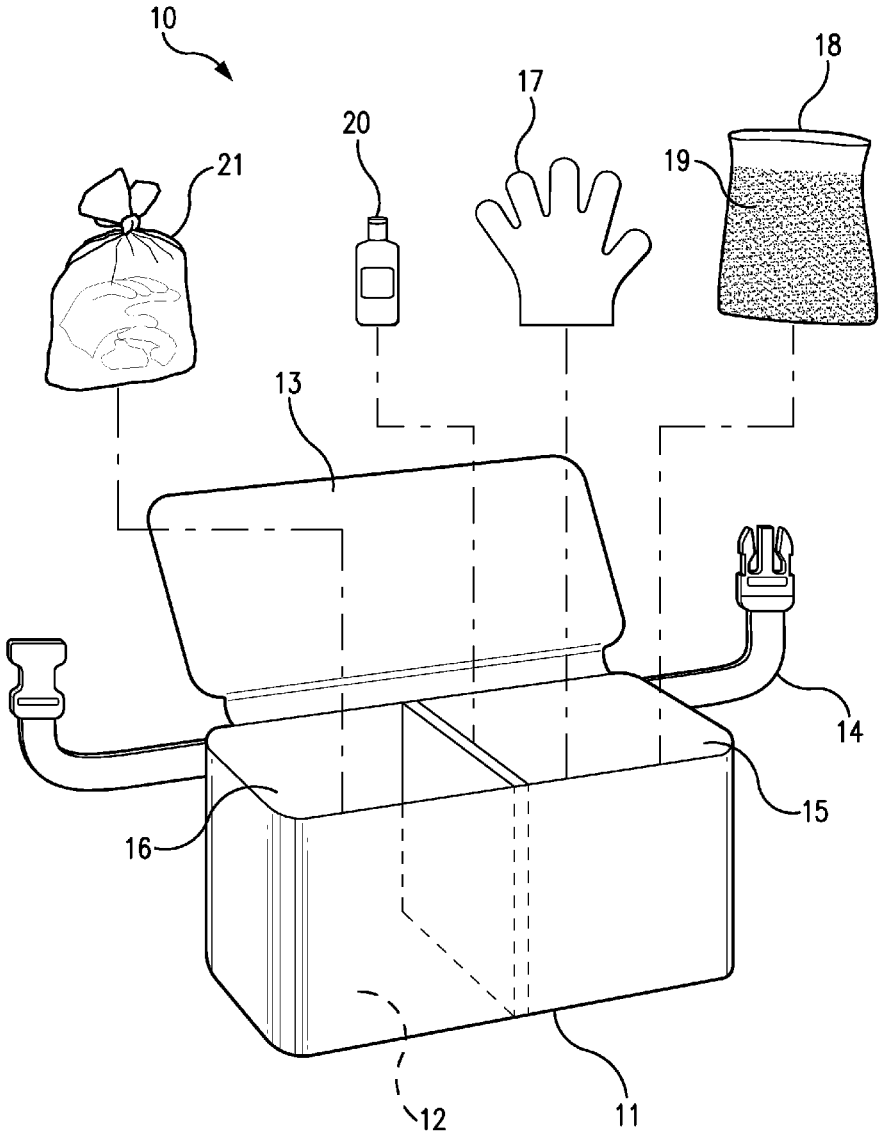
10
18
17
20
19
21
13
14
15
16
12
11

PET WASTE DISPOSAL KIT AND METHOD

FIELD OF INVENTION

The present invention relates to the field of equipment and methods for sanitary handling and disposal of biological wastes, and more particularly to equipment and methods for the sanitary handling and disposal of pet wastes.

BACKGROUND OF THE INVENTION

A perennial problem facing pet owners is the sanitary handling and disposal of their pets' excrement. Public health regulations now universally require pet owners to thoroughly clean up and safely dispose of their animals' droppings, but the methods commonly employed are often extremely unsanitary. Even when disposal bags are used to collect and store the waste, the manual handling of such bags exposes the pet owner, as well as those they come into contact with, to biological hazards. Moreover, such pet waste disposal bags are typically mixed with household refuse for disposal without any treatment of their pathogen content whatsoever, thereby endangering public health.

Consequently, there is a great unfulfilled need for a standardized sanitary procedure for handling and disposing of pet waste and for a complete kit to implement that procedure. Providing such a kit and the method of its use is the principal objective of the present invention.

SUMMARY OF THE INVENTION

The present invention is directed to the following objectives:

(a) that the pet handler's hands be protected with impermeable gloves at all times when pet waste is being collected or handled;

(b) that collected pet waste and gloves that have been in contact with pet waste be secured in waste collection bags containing chemicals that deodorize the waste and inhibit bacterial growth therein;

(c) that waste collection bags be secured in an impermeable secondary container attachable to the pet handler's body, so as to avoid manual handling of the collection bags until they can be safety disposed of; and (d) that the pet handler's hands be sanitized promptly after the gloves are removed and the waste collection bags are secured in the secondary container.

Therefore, the pet waste disposal kit of the present invention includes the following items:

(1) a kit bag with an impermeable lining that can be worn around the waist or over the shoulder of the pet handler, such that the kit bag serves as the secondary container to secure the filled waste collection bags, and it also serves to store the other materials comprising the kit;

(2) a supply of lightweight, impermeable, biodegradable plastic gloves, which can be made of biodegradable polyethylene;

(3) a supply of waste collection bags made of lightweight, impermeable, biodegradable plastic, containing a disinfecting-deodorizing mixture, comprising a highly alkaline compound, a desiccant and a deodorizer, wherein the bags have a secure sealing means, such as re-sealable zip-locks or twist ties; and (4) a supply of antiseptic hand wipes or a liquid hand sanitizer.

The kit is employed using the following method:

(i) a pair of gloves are removed from the kit bag and worn on the pet handler's hands;

(ii) a waste collection bag is removed from the kit bag and opened;

(iii) the pet waste is picked up with one or both of the gloved hands and put into the waste collection bag;

(iv) the gloves are removed and put into the waste collection bag;

(v) the waste collection bag is sealed and is shaken to coat the waste and gloves with the disinfecting-deodorizing mixture;

(vi) the sealed waste collection bag is put into the kit bag; and (vii) the pet handler's hands are sanitized with antiseptic hand wipes or liquid hand sanitizer.

Alternately, the disinfecting-deodorizing mixture can be kept in a separate container and added to the waste collection bag after the pet waste and the gloves have been inserted therein. Another alternative is to have the disinfecting-deodorizing mixture constitute a coating on the interior of the waste collection bags.

Since high alkalinity (pH>11) and low moisture content are known to be effective in inhibiting bacterial growth, the disinfecting-deodorizing mixture contains one or more highly alkaline compounds, such as lime (calcium hydroxide, also known as hydrated lime). Lime can create pH levels greater than 12, which is sufficient to destroy the cell membranes of most pathogens. The high alkalinity of compounds such as lime also repels insects from infesting the treated waste. Lime also produces free calcium ions, which are effective in destroying odorous sulfur compounds. To reduce the moisture content of the treated waste, the disinfecting-deodorizing mixture also contains a desiccant, such as silica, activated charcoal or calcium chloride. The third component of the mixture is a deodorizer, such as baking soda (sodium bicarbonate).

The foregoing summarizes the general design features of the present invention. In the following sections, specific embodiments of the present invention will be described in some detail. These specific embodiments are intended to demonstrate the feasibility of implementing the present invention in accordance with the general design features discussed above. Therefore, the detailed descriptions of these embodiments are offered for illustrative and exemplary purposes only, and they are not intended to limit the scope either of the foregoing summary description or of the claims which follow.

BRIEF DESCRIPTION OF THE DRAWINGS

FIG. 1 is an exploded view of a pet waste disposal kit in accordance with the preferred embodiment of the present invention.

DETAILED DESCRIPTION OF THE PREFERRED EMBODIMENT

As illustrated in FIG. 1, the preferred embodiment of the present invention 10 comprises a kit bag 11 with an impermeable liner 12, a closure flap 13, and an adjustable belt 14 for securing the kit bag 11 around the waist of a pet handler. The interior of the kit bag is divided into two compartments: a supplies compartment 15 and a disposal compartment 16, in order to avoid contamination of the supplies.

The supplies stored in the supplies compartment comprise: (1) a supply of lightweight, impermeable, biodegradable plastic gloves 17, (2) a supply of sealable waste collection bags 18 made of lightweight, impermeable, biodegradable plastic, with the interior of the bags coated with a disinfecting-deodorizing mixture 19, and (3) a supply of a liquid hand sanitizer 20.

The disinfecting-deodorizing mixture 19 comprises three components: a disinfectant, a desiccant and a deodorizer. In the preferred embodiment 10, the disinfectant is lime, the desiccant is silica, and the deodorizer is baking soda. The preferred composition by weight is approximately 50% lime, 25% silica and 25% baking soda.

The kit is employed by the pet handler first removing a pair of gloves 17 from the kit bag 10 and wearing them on his/her hands. A waste collection bag 18 is then removed from the kit bag 10 and opened. The pet waste is then picked up with the gloved hand(s) and put into the opened waste collection bag 18. Next the pet handler removes the gloves 17 and puts them into the waste collection bag 18. Then the waste collection bag 18 is sealed, and the sealed waste collection bag 21, containing the soiled gloves 17 and the pet waste, is shaken to coat the waste and gloves with the disinfecting-deodorizing mixture 19. Finally, the sealed waste collection bag 21 is put into the disposal compartment 16 of the kit bag 11, and the pet handler applies the hand sanitizer to disinfect his/her hands.

After following this procedure, the pet handler can now return home and safely dispose of the sealed waste collection bag 21 with his/her regular household waste, since the pet waste and soiled gloves 17 have been disinfected and deodorized, and since the waste collection bag 21 and all of its contents are biodegradable.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. A method by which a pet handler can safely handle and dispose of pet waste, the method comprising the following steps:

(a) providing multiple sealable waste disposal bags, made of lightweight, impermeable, biodegradable plastic, wherein each of the waste disposal bags contains or is interiorly coated with a disinfecting-deodorizing mixture, comprising a disinfectant, a desiccant and a deodorizer, and wherein the disinfectant consists of calcium hydroxide, the desiccant consists of silica, and the deodorizer, consists of baking soda;

(b) providing multiple pairs of gloves, made of lightweight, impermeable, biodegradable plastic;

(c) providing one or more hand sanitizers, comprising multiple hand sanitizing wipes, or one or more bottles of a hand sanitizing liquid;

(d) providing a wearable kit bag, in which are stored the waste disposal bags, the gloves and the hand sanitizers;

(e) removing a pair of the gloves from the kit bag and having the pet handler wear the gloves on his/her hands;

(f) removing a waste disposal bag from the kit bag and opening the waste disposal bag;

(g) manually picking up the pet waste and putting the pet waste into the waste disposal bag;

(h) removing the gloves from the pet handler's hands and putting the gloves into the waste disposal bag;

(i) sealing the waste disposal bag and shaking it, so as to coat the pet waste and the gloves with the disinfecting-deodorizing mixture;

(j) sealing the waste disposal bag and putting it into the kit bag; and (k) sanitizing the pet handler's hands using the hand sanitizers.

* * * * *